US006561768B2

(12) United States Patent
Bodzak

(10) Patent No.: US 6,561,768 B2
(45) Date of Patent: May 13, 2003

(54) DEVICE FOR SUPPLYING LIQUIDS, IN PARTICULAR, FUEL

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/989,950

(22) Filed: Nov. 20, 2001

(65) Prior Publication Data

US 2002/0114703 A1 Aug. 22, 2002

(30) Foreign Application Priority Data

Nov. 30, 2000 (DE) ..... 100 59 423

(51) Int. Cl.[7] ..... F04B 23/04
(52) U.S. Cl. ..... 417/62; 417/223
(58) Field of Search ..... 417/223, 216, 417/319, 426, 429, 62

(56) References Cited

U.S. PATENT DOCUMENTS 3,630,643 A * 12/1971 Eheim et al. ..... 417/62
4,525,126 A * 6/1985 Laumont ..... 417/310
4,977,882 A * 12/1990 Nakamura et al. ..... 123/502
5,006,048 A * 4/1991 Jow ..... 417/410.4
5,993,169 A * 11/1999 Adachi et al. ..... 417/223
6,048,187 A * 4/2000 Hamasaki et al. ..... 418/206.1
6,474,938 B2 * 11/2002 Dalton et al. ..... 415/55.1

FOREIGN PATENT DOCUMENTS

DE 196 38 332 A1 3/1998
EP 0 657 642 A2 6/1995

* cited by examiner

*Primary Examiner*—Charles G. Freay
*Assistant Examiner*—William H. Rodriguez
(74) *Attorney, Agent, or Firm*—Michael J. Striker

(57) ABSTRACT

A device for supplying liquids, in particular, fuel, has a first geared supply pump (30) with a pair of meshed gear wheels (41, 43) in a pump chamber, of which one is rotatably driven by means of a drive shaft (38). In the pump chamber (40), an inlet opens on a suction side (48) and an outlet (86) opens on a pressure side (49). In the direction of rotational axes (42, 45) of the gear wheels (41, 43) of the first supply pump (30), a second geared supply pump (60) is provided, which has a meshed pair of gear wheels (64, 68) in a pump chamber (62). One of the gear wheels (64) of the second supply pump (60) is rotatably and lockingly connectable to the drive shaft (38) by means of a coupling arrangement (66). The coupling arrangement (66) is controlled by the existing pressure on the pressure side (49) of the first geared supply pump (30). In this manner, with a low pressure, the gear wheel (64) is rotatably and interlockingly coupled to the drive shaft (38) and with a high pressure, the gear wheel (64) is separated from the drive shaft (38). Thus, with a lower pressure, both pumps supply fuel, and with a higher pressure, only the first pump supplies the fuel.

11 Claims, 3 Drawing Sheets

DEVICE FOR SUPPLYING LIQUIDS, IN PARTICULAR, FUEL

BACKGROUND OF THE INVENTION

The present invention relates to a device for supplying liquids, particularly fuel.

One such device is disclosed in DE 196 38 332 A1. This device has a geared supply pump, the pump having a pair of meshed, rotatable gear wheels, by which one gear wheel is rotatably driven by a drive shaft. In the pump chamber, an inlet on the suction side of the geared supply pump opens for the supply liquid and on the pressure side, an outlet for the supplied liquid is provided. The drive shaft is mechanically driven by an internal combustion engine, for example, to which the device supplies the fuel. Upon starting of the internal combustion engine, the geared supply pump drives the device with only a low speed of rotation so that only a small fuel volume is supplied, which under the circumstances, does not make possible a guaranteed starting of the internal combustion engine. Especially with a higher fuel temperature and a lower rotational speed of the internal combustion engine, for example, as a result of an insufficient voltage in an electrical voltage source used for starting the engine, the supply pump supplies an insufficient amount of fuel. The geared supply pump could be modified in this regard so that it supplies a greater amount of fuel. However, under other operating conditions, the supplied fuel volume would be too large and would have to be needlessly regulated.

SUMMARY OF THE INVENTION

In contrast with the above-described device, the present invention provides the advantage that with low pressure on the pressure side, the first geared supply pump switches on a second geared supply pump by means of a coupling arrangement, and thereby, the supplied amount of liquid is increased. When the pressure on the pressure side of the first geared supply pump is sufficiently high, and by means of the first geared supply pump, a sufficiently high amount of liquid is supplied, the second geared supply pump is no longer driven by means of the coupling arrangement.

The present invention also makes possible a suctioning of liquid by means of both geared supply pumps through a common inlet. In addition, with the present invention, a flowing-out of the liquid supplied through both geared supply pumps is made possible by means of a common outlet, whereby, by means of the check or relief valve, a flowing-away of the fuel is prevented when the second geared supply pump is switched on. The present invention also provides that the flowing away of a portion of the liquid volume supplied by the first geared supply pump is dependent on pressure on the pressure side, whereby the supplied volume can be limited. In addition, a preferred embodiment of the coupling arrangement is contemplated and will be described in greater detail below.

DETAILED DESCRIPTION OF THE PREFERRED EMBODIMENTS

Figure 1:
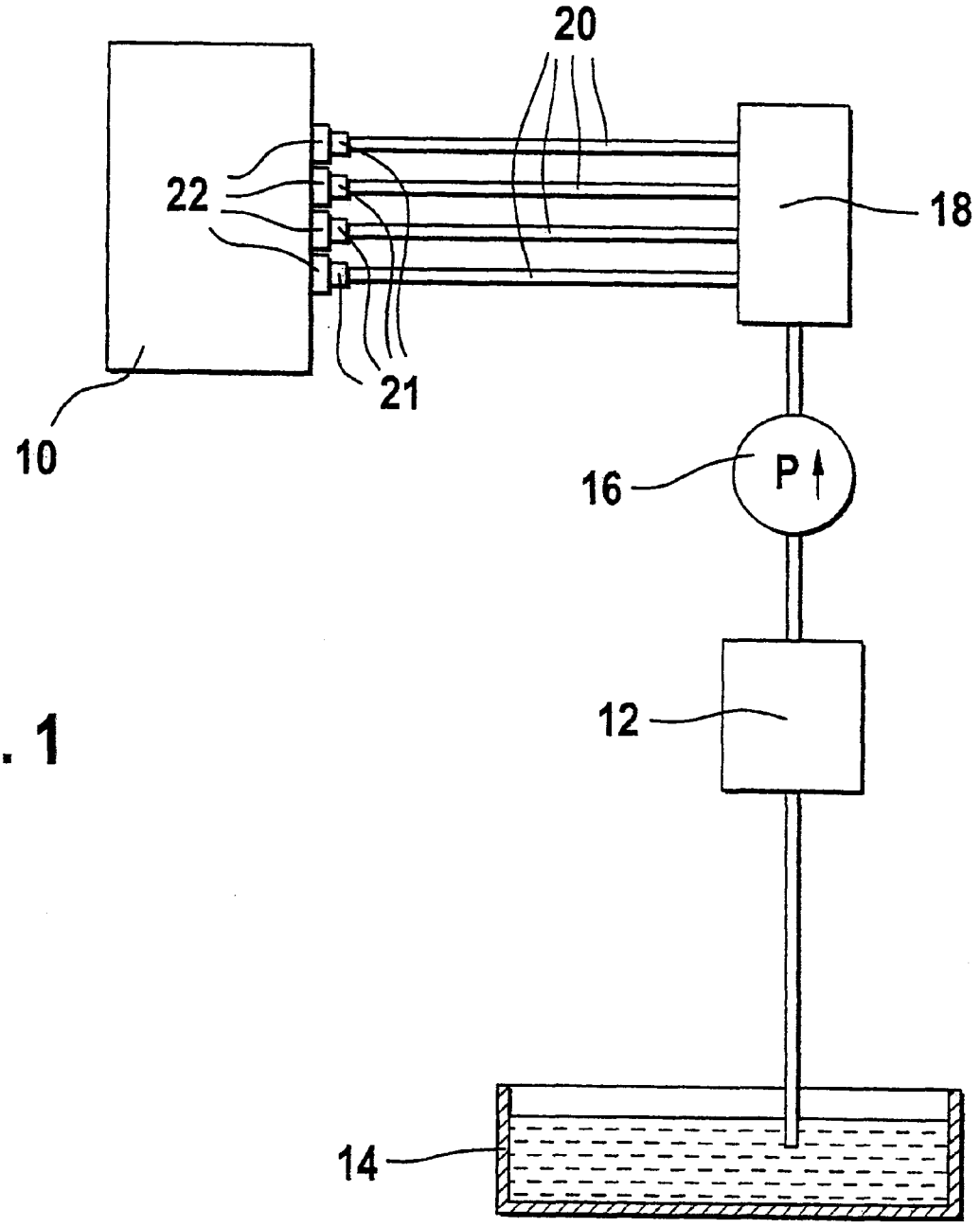
FIG. 1 shows a fuel supply device for an internal combustion engine, according to the present invention, with an arrangement for supplying fuel.

In FIG. 1, a fuel supply apparatus for an internal combustion engine 10 of a motor vehicle or a stationary internal combustion engine is illustrated, which, in particular, is a self-igniting internal combustion engine. The fuel supply apparatus has a device 12 for supplying fuel from a storage tank 14. The device 12 has two supply pumps, which will be described in greater detail below. Downstream of the device 12, a high-pressure pump 16 is arranged, whose suction side is supplied with the fuel from the device 12. Downstream from the high-pressure pump 16, a high pressure storage unit 18 is arranged, from which lines 20 lead to injectors 22 on the cylinders of the internal combustion engine 10. By means of the injectors 22, fuel is injected into the combustion chamber of the cylinder of the internal combustion engine 10. For regulating the injection process of the injectors 22, valves 21 are provided, through which the connection of the injectors 22 with the high-pressure storage unit 18 can be opened or closed. Alternatively, it can also be provided that instead of the high-pressure pump 16 and the high-pressure storage unit 18, a fuel injection pump is provided, whose suction side is connected with the device 12. Further, it can alternatively be provided that for each cylinder of the internal combustion engine 10, a high-pressure pump or fuel injection pump is provided, whose suction side is connected with the device. The high-pressure storage unit 18 is then not applicable.

Figure 2:
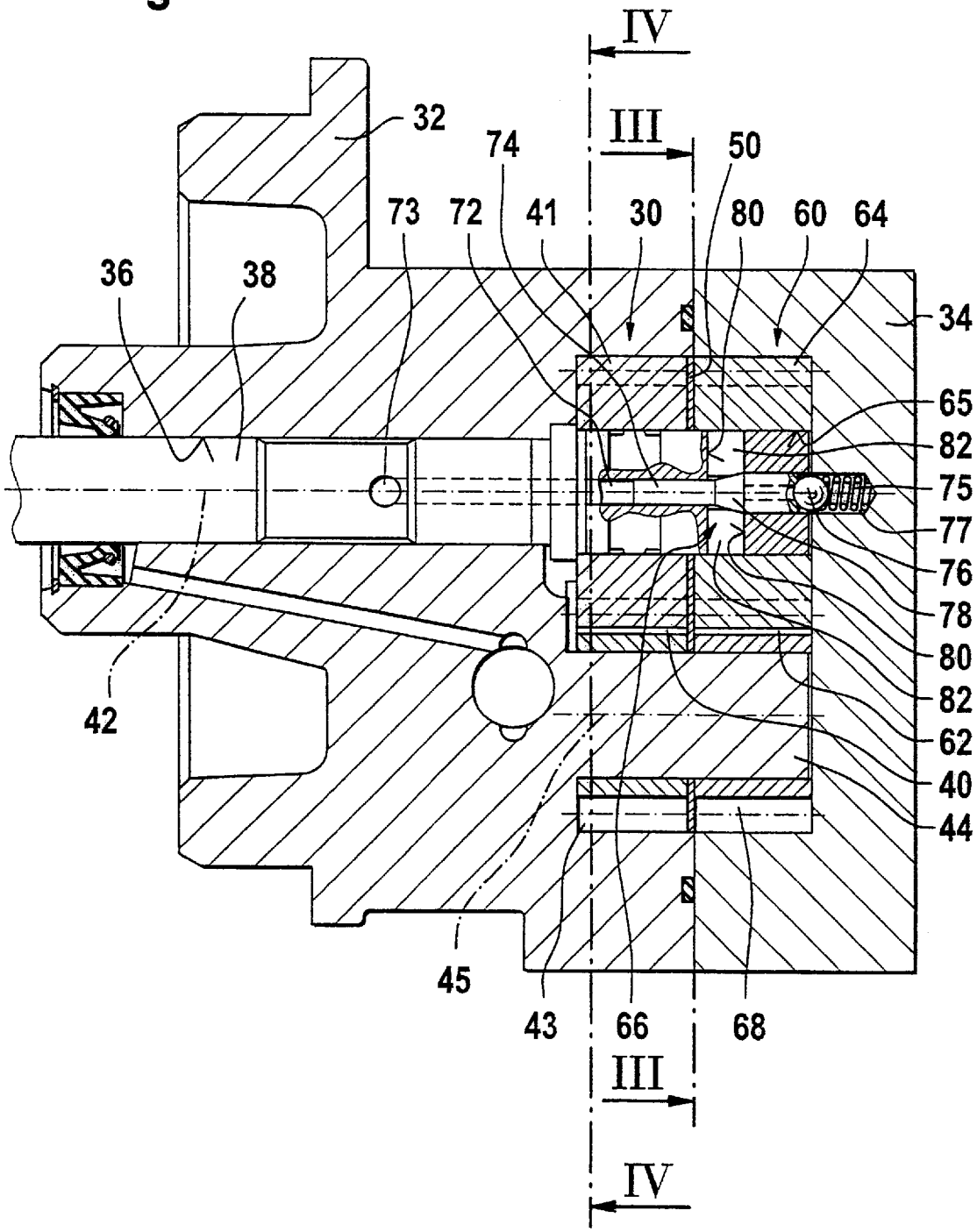
FIG. 2 shows the arrangement for supplying fuel in a longitudinal section.
Figure 3:
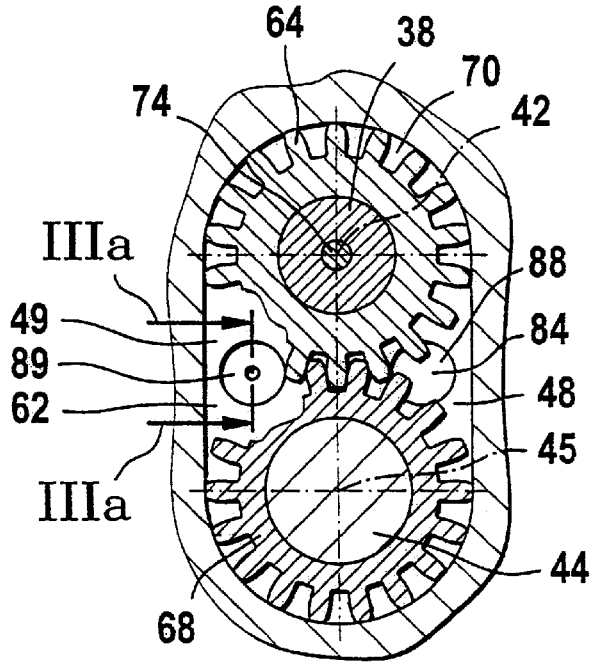
FIG. 3 shows the arrangement for supplying fuel in a cross-section taken along Lines III—III of FIG. 2.
Figure 4:
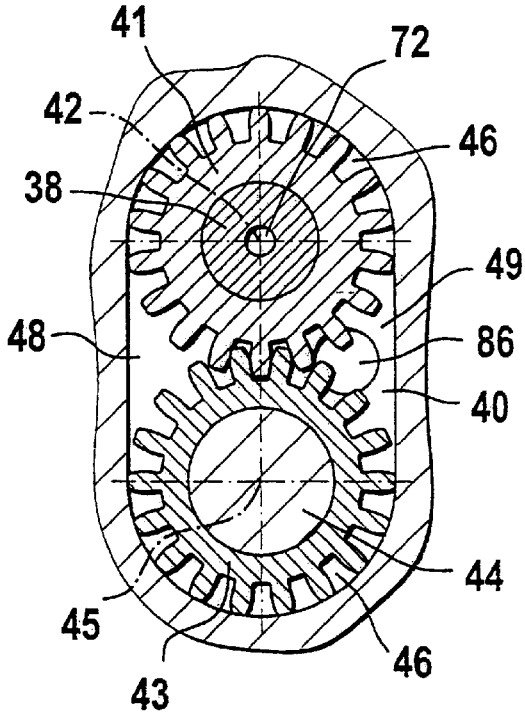
FIG. 4 shows the arrangement for supplying fuel in a cross-section taken along Lines IV—IV in FIG. 2.

In FIGS. 2 through 4, the device 12 is shown in detail. The device 12 has a first geared supply pump 30 and a second geared supply pump 60. The device 12 comprises a multi-part housing with a housing portion 32 and the cover portion 34 connected to the housing portion 32. The housing portion 32 has a hole 36 through which a drive shaft 38 projects from the exterior. The drive shaft 38 is mechanically driven by means of the internal combustion engine 10. A pump chamber 40 is formed for the first geared supply pump 30 by means of a recess in a side of the housing portion 32 facing the cover portion 34. The first geared supply pump 30 has a gear wheel 41 arranged in the pump chamber 40 with a radial serration, which is rotatably, interlockingly coupled with the drive shaft 38 and is rotatably driven about a rotational axis 42 by means of the drive shaft 38. In addition, the first geared supply pump 30 has a gear wheel 43 arranged in the pump chamber with a radial serration, which engages the gear wheel 41 and which is rotatably supported on a journal 44 about a rotational axis 45. The rotational axes 42, 45 of the gear wheels 41, 43 run parallel to one another. The journal 44 can be formed as a one-piece unit with the housing portion 32 and project into the pump chamber 40. Upon operation of the geared supply pump 30, by means of the rotating gear wheels 41, 43, fuel is supplied from the suction side 48 to a pressure side 49 along the circumference of the gear wheels between the gear wheels and the supply channels 46 which define the pump chamber 40. In the area of the supply channels 46, the pump chamber 40 runs with a small distance from the circumference of the gear wheels 41, 43. The engagement of the gear wheels 41, 43 creates a seal between the suction side 48 and the pressure side 49 of the geared supply pump 30.

In the direction of the rotational axes 42, 45 of the gear wheels 41, 43, the pump chamber 40 is defined on one side by the housing portion 32 and on the other side by a dividing wall 50. The gears 41, 43 are arranged with the least possible play between the housing part 32 and the dividing wall 50 in order to guarantee a sealing of the supply channels 46.

In a side of the cover portion 34 facing the housing portion 32, a second pump chamber 62 is formed by means of a recess for the second geared supply pump 60. The pump chamber 62, in cross-section, is formed at least approximately the same as a cover for the opposite pump chamber 40 in the housing portion 32. The second geared supply pump 60 has a gear 64 with a radial serration arranged in the pump chamber 62, the gear 64 having a bore 65 and being arranged on the drive shaft 38. The gear 64 is rotatably, interlockingly coupled with the drive shaft 38 by means of a coupling arrangement 66, which will be described in greater detail below, and is thus rotatably driven about a rotational axis 42. The second geared supply pump 60, in addition, has a gear wheel 68 arranged in the pump chamber 62 with a radial serration, which meshes with the gear wheel 64 and is rotatably supported on the journal 44 about the rotational axis 45. The rotational axes 42, 45 of the gear wheels 41, 43 of the first geared supply pump 30 and the gear wheels 64, 68 of the second geared supply pump 60 are identical. The journal 44 projects through an opening in the dividing wall 50 through to the pump chamber 62. Upon operation of the second geared supply pump 60, by means of the rotating gear wheels 64, 68, fuel is supplied from the suction side 48 to a pressure side 49 along the circumference of the gear wheels between the gear wheels 64, 68 and the supply channels 70 which define the pump chamber 62.

Next, the coupling arrangement 66 will be described in more detail. The drive shaft 38 has a longitudinal bore 72 in an end area arranged in the housing, the longitudinal bore 72 running parallel to the longitudinal axis 42 of the drive shaft 38, which is also the rotational axes of the gear wheels 41 and 64. The longitudinal bore 72 is connected to the pressure side 49 via a transverse bore 73 so that the existing pressure on the pressure side 49 operates in the longitudinal bore 72. A piston 74 is guided tightly endwise into the longitudinal bore 72, which is impinged on one face by pressure on the pressure side 49. The piston 74 is braced on its opposite face by a biased spring 75 on the cover portion 34. Between the face of the piston 74 and the spring 75, a generally cone-shaped support element 76 is arranged. The cover portion 34 has pocket bore 77 opposite to the piston 74, in which the spring 75 is arranged. The pocket bore 77 is connected with the suction side of the geared supply pump 60. By means of the spring 75, a restoring force is exerted onto the piston 74, which works against the force acting on the piston 74 from the pressure on the pressure side 49.

The piston 74 has a facet 78 on its outer surface, which, for example, is formed by means of a conically shaped portion of the piston 74. Through the facet 78, the outer surface of the piston 74 runs at an incline from the face of the piston 74 on which the spring 75 is braced to the face on which the pressure of the pressure side 49 acts. The piston 74, therefore, has a section with a smaller diameter, which is tightly guided into a section of the longitudinal bore 73 with a corresponding diameter and is impinged on one surface or face with pressure from the pressure side 49. In addition, the piston 74 has a section with a greater diameter, which is guided into an end area of the longitudinal bore 73 with a corresponding larger diameter and on whose surface, the support element 76 is braced.

In an area in which the gear 54 is positioned, the drive shaft 38 has at least one radial bore 80 which opens into the longitudinal bore 73 and which is approximately radial to the longitudinal axis 42 of the drive shaft 38. Preferably, at least one or more radial bores 80 are provided about the circumference, or periphery, of the drive shaft 38. In each radial bore 80, a grip-spring tensioning element 82 is adjustably guided, the radial end of which braces on the facet 78 of the piston. On its radial outer end, each tensioning element 82 abuts the periphery of the bore 65 in the gear wheel 64. The tensioning elements 82 can be slide rings, by way of example. On its radial inner end, each tensioning element can be concavely curved to the shape of the piston. At its radial outer end, each tensioning element 82 can be convexly curved to the shape of the bore 65 of the gear wheel 64.

Figure 3A:
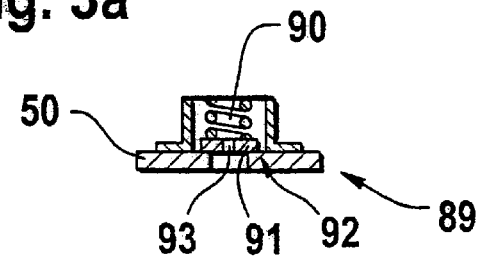
FIG. 3*a* shows a check valve of FIG. 3 in a longitudinal section.

In the cover portion 34, an inlet 84 opening into the pump chamber 62 is formed in the suction side 48, through which fuel from a storage tank 14 can be introduced. In the housing portion 32, an outlet 86 opening into the pump chamber 40 is formed on the pressure side 49, through which the fuel can be taken out through a high-pressure pump 16. The dividing wall 50 has an opening 88 on the suction side 48, through which the pump chamber 40 of the first geared supply pump 30 is connected with the pump chamber 62 of the second geared supply pump 60. On the dividing wall 50, a connection on the pressure side 49 of the pump chamber 40 of the first geared supply pump with the pump chamber 62 of the second geared supply pump 60 is controllable by means of a check or relief valve 89. The check valve 89 opens into the pump chamber 40 of the first geared supply pump 30. The check valve 89 has a valve member 92, acted upon by means of a locking spring, which cooperates with a valve seating 92 on the dividing wall 50, as shown in FIG. 3*a*. On the check valve 89, a fixed, opened, throttled, pressure-side connection between the pump chamber 40 of the first geared supply pump 30 and the pump chamber 62 of the second geared supply pump 60 is provided. This throttled connection can be formed, by way of example, by a choke bore 93 in the valve member 91.

Next, the functioning of the device 12 with the first geared supply pump 30 and the second geared supply pump 60 will be explained. When the drive shaft 38 of the device is driven with only a lower rotational speed, for example, when the internal combustion engine 10 is started, the geared supply pumps 30, 60 have a correspondingly low rotational speed on their pressure sides 49, as only a low pressure is present. The first geared supply pump 30 is always driven by the drive shaft 38. In the event of a low pressure on the pressure side 49, the piston 74 of the coupling arrangement 66 is pressed to the left by the spring 75, as shown in FIG. 2, so that the tensioning element 82 is pressed radially outward by the facet 78 which slopes is this direction. In addition, the tensioning element 82 is pressed radially outward through the centrifugal force produced by the rotation of the drive shaft 38. Through the pressure of the tensioning element 82 on the gear wheel 64 in its bore 65, a rotatable, interlocking coupling of the gear 64 with the drive shaft 38 takes place, by means of the existing friction, and therewith, the drive of the second geared supply pump 60. With low pressure on the pressure site 49 of the device, both geared supply pumps 30, 60 are driven and supply fuel. When the supply pressure produced by the second geared supply pump 60 is greater than the supply pressure produced by the first geared supply pump 30, the check valve 89 is opened and the fuel delivered by means of the second geared supply pump 60 arrives on the pressure side 49 of the first geared supply pump 30, and from there, goes to the high-pressure pump 16 via the outlet 86. The second geared supply pump 60 suctions fuel on the suction side 48 via the inlet 84 and the first geared supply pump 30 likewise suctions fuel through the inlet 84 via the opening 88 in the dividing wall 50.

When the pressure on the pressure side 49 of the device increases, the piston 74 is shifted to the right against the pressure of the spring 75, as shown in FIG. 2. In this direction, the facet 78 slopes so that the tensioning element 82 is no longer radially and outwardly pressed, and correspondingly, is no longer pressed into the bore 65 against the gear wheel 64. The pressing of the tensioning element 82 through the centrifugal force no longer suffices for maintaining the coupling between the gear wheel 64 and the drive shaft 38, so that the second supply pump 60 is no longer driven. In this case, the pressure on the pressure side 49 of the first supply pump 30 is higher than the pressure on the pressure side 49 of the second supply pump 60, so that the check valve 89 is closed. When the valve member 91 of the check valve 89 has the choke bore 93, a partial volume of the supplied fuel flows away from the pressure side 49 of the first geared supply pump 30 onto the pressure side of the second geared supply pump 60, on which, however, a smaller pressure exists, since this pump 60 is not being driven.

Alternatively to the above-described embodiment, it can also be provided that the geared supply pumps 30, 60 each have separate inlets and outlets. In this case, the dividing wall 50 can be closed and the opening 88 and the check valve 89 can be inapplicable. The piston 74 of the coupling arrangement 66, thereby, is impinged with pressure on the pressure side of the first geared supply pump 30. Both geared supply pumps 30, 60 are switched on in parallel, and with a low pressure on the pressure side of the first geared supply pump 30, fuel from the storage tank 14 is supplied by both pumps 30, 60 to the high-pressure pump 16. Through corresponding dimensioning of the spring 75 and the restoring force produced by the spring 75, as well as the diameter of the piston 74, the resulting pressure can be adjusted until it reaches a pressure on the pressure side 49 with which it can drive the second geared supply pump 60, and with an even higher pressure, can switch the supply pump 60 on.

It will be understood that each of the elements described above, or two or more together, may also find a useful application in other types of constructions differing from the types described above.

While the invention has been illustrated and described herein as a device for supplying liquids, especially fuel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device for supplying liquids, especially fuel, comprising:

a first geared supply pump (30), said first geared supply pump (30) having a first pair of meshed gear wheels (41, 43) in a first pump chamber (40), wherein one of said first pair of gear wheels (41) is rotatably driven by a drive shaft (38), said first pump chamber (40) having a suction side (48) and a pressure side (49), wherein an inlet (84) opens on said suction side (48) and wherein an outlet (86) opens on said pressure side (49);

a second geared supply pump (60) arranged in a direction of rotational axes (42, 45) of said first pair of gear wheels (41, 43) of said first geared supply pump (30), said second geared supply pump (60) having a second pair of meshed gear wheels (64, 68) in a second pump chamber (62), wherein one of said second pair of gear wheels (64) is rotatably and interlockingly connectable to the drive shaft (38) by means of a coupling arrangement (66), wherein said coupling arrangement (66) is controlled by a pressure on said pressure side (49) of said first geared supply pump (30), wherein when a low pressure prevails on said pressure side (49), one of said second pair of gear wheels (64) is rotatably and interlockingly coupled to said drive shaft (38), and wherein when a high pressure prevails on said pressure side (49), said one of said second pair of gear wheels (64) is separated from said drive shaft (38).

2. The device as defined in claim 1, wherein the first pump chamber (40) and the second pump chamber (62) are separated from one another by a dividing wall (50) in a direction of said rotational axes (42, 45) of the first and second pairs of gear wheels (41, 43; 64, 68).

3. The device as defined in claim 2, wherein said dividing wall (50) has at least one opening (84) on the suction side (48), and wherein said first and second pump chambers (40, 62) of said first and second geared supply pumps (30, 60), respectively, are connected to one another by said at least one opening (84).

4. The device as defined in claim 2, wherein a check valve (89) is arranged on the dividing wall (50) on said pressure side (49), said check valve (89) opening into said first pump chamber (40), wherein said check valve (89) connects said first and second pump chambers (40, 62).

5. The device as defined in claim 2, wherein a fixed, opened throttle connection (93) between said first and second pump chambers (40, 62) is formed through said dividing wall (50) on said pressure side (49).

6. The device as defined in claim 1, wherein said one of said second pair of gear wheels (64) of said second geared supply pump (60) is positioned on said drive shaft (38), wherein said coupling arrangement (66) has a piston (74), said piston (74) impinged on a side proximate to said outlet (49) by pressure and tightly guided endwise against a restoring force into a longitudinal bore (72) of said drive shaft (38), said piston (74) having a longitudinally running facet (78) on an outer surface, wherein a tensioning element is braced against said outer surface of said piston (74), said tensioning element (82) slidingly guided into the drive shaft (38) approximately radially to a shifting direction of said piston (74).

7. The device as defined in claim 6, wherein when said piston (74) is shifted by said restoring force against pressure on said side of said piston proximate to said outlet (49) over said facet (78) by said piston (74), said tensioning element (82) is pressed against said one of said second pair of gear wheels by said piston (74), thereby causing said coupling of said one of said second pair of gear wheels (64) with said drive shaft (38).

8. The device as defined in claim 7, wherein said piston (74) has a generally conically shaped section for forming said facet (78).

9. The device as defined in claim 7 or 8, wherein said restoring force on said piston (74) is produced by a biased spring (75), said spring (75) biased between said piston (74) and a secured housing portion (34).

10. The device as defined in claim 9, wherein said spring (75) is braced on said piston (74) by means of a generally cone-shaped support element (76).

11. The device as defined in claim 1, wherein said first and second geared supply pumps (30, 60) are switched on in parallel.

* * * * *